US011498800B1

(12) United States Patent
Martirez

(10) Patent No.: US 11,498,800 B1
(45) Date of Patent: Nov. 15, 2022

(54) TAPE ROLL HOLDER

(71) Applicant: Emmanuel Robles Martirez, St. Louis, MO (US)

(72) Inventor: Emmanuel Robles Martirez, St. Louis, MO (US)

( * ) Notice: Subject to any disclaimer, the term of this patent is extended or adjusted under 35 U.S.C. 154(b) by 252 days.

(21) Appl. No.: 16/894,433

(22) Filed: Jun. 5, 2020

Related U.S. Application Data

(60) Provisional application No. 62/858,810, filed on Jun. 7, 2019.

(51) Int. Cl.

| | |
|---|---|
| ***B65H 75/20*** | (2006.01) |
| ***B65H 35/00*** | (2006.01) |
| ***B65H 75/08*** | (2006.01) |
| ***B43K 29/20*** | (2006.01) |

(52) U.S. Cl.
CPC ..... *B65H 75/20* (2013.01); *B43K 29/20* (2013.01); *B65H 35/0026* (2013.01); *B65H 75/08* (2013.01); *B65H 2301/5151* (2013.01); *B65H 2301/515326* (2013.01); *B65H 2701/377* (2013.01)

(58) Field of Classification Search
CPC .... B65H 75/20; B65H 35/0026; B65H 75/08; B65H 2301/5151; B65H 2301/515326; B65H 2701/377; B43K 29/20
See application file for complete search history.

(56) References Cited

U.S. PATENT DOCUMENTS

| | | | | |
|---|---|---|---|---|
| 1,818,514 | A | 8/1931 | Whitaker | |
| 2,640,656 | A | 6/1953 | Donkin | |
| 3,134,526 | A | 5/1964 | Schleicher | |
| 3,623,643 | A * | 11/1971 | Ikeda | B65H 35/0026 225/70 |
| 4,130,229 | A | 12/1978 | Pagnini | |
| 4,884,734 | A | 12/1989 | Kahl, Jr. et al. | |
| 4,919,276 | A | 4/1990 | Kim et al. | |
| D393,002 | S | 3/1998 | Mandar | |
| 5,820,005 | A * | 10/1998 | Perkitny | B65H 35/0026 225/65 |
| 5,921,450 | A * | 7/1999 | Robinson | B65H 35/0026 225/56 |
| 6,789,594 | B1 * | 9/2004 | Yu Chen | B65H 35/0026 225/56 |
| 10,435,268 | B2 | 10/2019 | Briggs et al. | |

(Continued)

*Primary Examiner* — William A. Rivera
(74) *Attorney, Agent, or Firm* — Creativenture Law, LLC; Dennis J M Donahue, III; Kevin Staed

(57) ABSTRACT

A tape roll dispenser has a backplate, a spindle, a cutting surface, a tab, and a writing device holder. The spindle is an arcuate channel with a bottom trough that extends outwardly from the upper section of the backplate and a sidewall that is parallel to the backplate's plane. The cutting surface extends outwardly from the bottom section of the backplate, and the tab extends upwardly from a center section of the cutting surface between serrated edges at opposite sides. The writing device holder has a pair of posts connected to and extending outwardly from the external surface of the sidewall with a rod connected between the posts and alternative writing device holders can be attached to different locations on the spindle or to the backplate, the cutting surface, or the tab. The serrated edges have a longer tooth positioned between two sets of teeth.

25 Claims, 2 Drawing Sheets

(56) References Cited

U.S. PATENT DOCUMENTS

| | | | | |
|---|---|---|---|---|
| 2002/0185512 | A1* | 12/2002 | Shah | B65H 35/0026 225/56 |
| 2014/0263525 | A1* | 9/2014 | Chen | B65H 35/008 225/77 |
| 2018/0319615 | A1* | 11/2018 | Matheny | A45F 5/021 |
| 2020/0031602 | A1* | 1/2020 | Sarkissian | B65H 35/0026 |
| 2020/0122881 | A1* | 4/2020 | Renkert | B65H 35/0086 |
| 2020/0277157 | A1* | 9/2020 | Carrion | B65H 35/002 |
| 2021/0053787 | A1* | 2/2021 | Cartlynne | B65H 35/0026 |

* cited by examiner

TAPE ROLL HOLDER

CROSS-REFERENCE TO RELATED APPLICATIONS

This application claims priority from U.S. Provisional Patent Application No. 62/858,810 filed on Jun. 7, 2019.

STATEMENT REGARDING FEDERALLY SPONSORED RESEARCH

Not Applicable.

APPENDIX

Not Applicable.

BACKGROUND OF THE INVENTION

Field of the Invention

The present invention relates to tape holders in which segments of adhesive tape can be dispensed from rolls of adhesive tape and relates more particularly to tape holders that are mounted to a vertical surface.

Related Art

Adhesive tape is an extremely versatile tool used in nearly every home, office, and industry. It is manufactured and sold in rolls made from a wide array of materials, a large variety of adhesives, and comes in a vast selection of formats for purposes ranging from general household use to highly specialized, industry-specific functions. Without a dispenser, rolls of adhesive tape can be difficult to use. The end of the tape spooled upon the roll adheres to the rest of the tape roll and it is often difficult for a user to locate the end of the tape and separate it from the rest of the roll for use. Once the end of the tape is located and separated, it is then often difficult for users to cut lengths of tape from the roll without the aid of scissors as tearing the tape by hand can be sloppy, imprecise, and difficult depending on the characteristics of the material of which the tape is made. In order to make the storage and cutting of lengths of tape from rolls of tape more convenient, a number of holders and dispensers have been developed over the years.

Tape dispensers designed to be kept on a table or countertop can be bulky and unsightly, add to clutter, and reduce the useable surface area. Other adhesive tape storage and dispensing devices are typically stored in a drawer and often become buried and entangled with other items making them difficult and inconvenient to find and extract. Since many current adhesive tape storage and dispensing devices merely sit on a surface and are freely movable, they are also frequently moved and then misplaced during their use which makes the tape unavailable for subsequent uses or other users who may expect the tape dispenser to be placed back in a designated storage location.

In an attempt to solve some of the known problems with misplacing tape dispensers that can be readily moved to different locations, U.S. Pat. No. 4,130,229 which is incorporated by reference herein discloses a tape dispenser particularly suited for dispensing tape when mounted on a substantially vertical surface. However, the '229 Patent follows the example of most previously known and current tape holders and dispensers which have a full circle spindle which holds the tape core and that require opening or partially disassembling parts of the dispenser in order to remove, replace and secure rolls of tape on the spindle. This process is accomplished with varying degrees of effort and difficulty depending on the complexity of the storage device. For example, the '229 Patent discloses a tape roll retaining cap which has a roll restraining head portion that must be separated from a plug portion in order to replace a roll of tape, and the roll restraining head portion must then be fit back into the plug portion to secure the roll of tape. A similar design is shown in U.S. Pat. No. 4,884,734 which is also incorporated by reference herein.

In other designs, such as shown in U.S. Des. Pat. 393,002 which is incorporated by reference herein, the dispenser can be opened by rotating a hinged cover away from the roll of tape to reveal the spindle and then rotated back to close over the roll of tape and hold it in place on the spindle. In other dispensers, such as disclosed in U.S. Pat. No. 4,919,276 which is incorporated by reference herein, the spindle has a shaft that is engaged and held in place by a pair of slots within a recess for the roll of tape, and the spindle must be removed from the slots to replace the roll of tape. In the '734 Patent, as well as many other tape dispensers in which the spindle can rotate relative to the cutting edge of the dispenser, the spindle is designed to have a peripheral surface which engages the core of the roll of tape with a friction fit so that the spindle rotates with the roll as segments of tape are pulled from the roll, and when the tape is spent, the spindle must be removed from the base of the dispenser so that it can be separated from the core and a new roll can be placed onto the spindle. In many instances, it would be preferable to be able to place the roll of tape onto the spindle without opening or disassembling parts of the dispenser.

One way to avoid opening or disassembling parts of the dispenser is to use a spindle that includes a flexible tab with a lip projecting outwardly at the distal end of the tab, such as disclosed in U.S. Pat. No. 10,435,268 and U.S. Pat. No. 2,640,656 which are incorporated by reference herein. The lip depresses inwardly to let the core of the tape pass over it and slide onto the spindle for usage without having to open or disassemble any part of the dispenser. Although the spindle with the flexible tab and lip results in an improved tape dispenser compared to the dispensers that require some disassembly or opening, the spindle still needs to be manipulated by a user to replace one roll of tape with another roll of tape, and there could be times when a user wants to use a roll of tape apart from a tape dispenser, and in such a case, it would be preferable if the user could more easily remove the tape from the dispenser without having to separately manipulate parts on the spindle.

As evident from the '276 Patent and the '002 Design Patent, some tape dispensers have been known to be combined with a pen holder and may also include a stamp dispenser, a tray for a memo pad, and/or a note pad. In the prior art, the pen holder is spaced a sufficient distance from the tape dispenser such that any pen in the pen holder would not need to be moved when a roll of tape is being replaced in the tape dispenser. For economy in the use of material to make the tape dispenser as well as efficiency in the use of space by the tape dispenser, it would be advantageous in some installations of a tape dispenser for the pen holder to be formed as a part of a feature in the tape dispenser.

Accordingly, there remains a desire for a tape dispenser in which a roll of tape can be replaced without opening or disassembling parts of the dispenser or any manipulation of the spindle. It would also be beneficial for the tape dispenser to allow a user to separate a roll of tape from the dispenser for use away from the dispenser by just grasping the tape and without having to open, disassemble, or otherwise manipulate any part of the tape dispenser. There may be additional benefits for the economic use of material in the manufacture of the tape dispenser and for the efficient use of space in the installation of the tape dispenser, particularly including an integral writing device holder for a marker, pen, or other writing implement.

SUMMARY OF THE INVENTION

The invention is a dispenser for a roll of tape. In one aspect of the invention, the spindle that holds the roll of tape has an arcuate channel with a bottom trough that extends outwardly from the upper section of the backplate and an integral sidewall that is parallel to the backplate's plane. The cutting surface extends outwardly from the bottom section of the backplate, and a tab extends upwardly from a center section of the cutting surface between serrated edges at opposite sides.

In another aspect of the invention, a writing device holder has a pair of posts that are connected to and extend outwardly from the external surface of the sidewall with a rod connected between the posts.

In yet another aspect of the invention, the cutting surface's serrated edges have a longer tooth positioned between two sets of teeth.

Additionally, a further aspect of the invention is a writing device holder that is formed as a part of the tape dispenser.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 3:
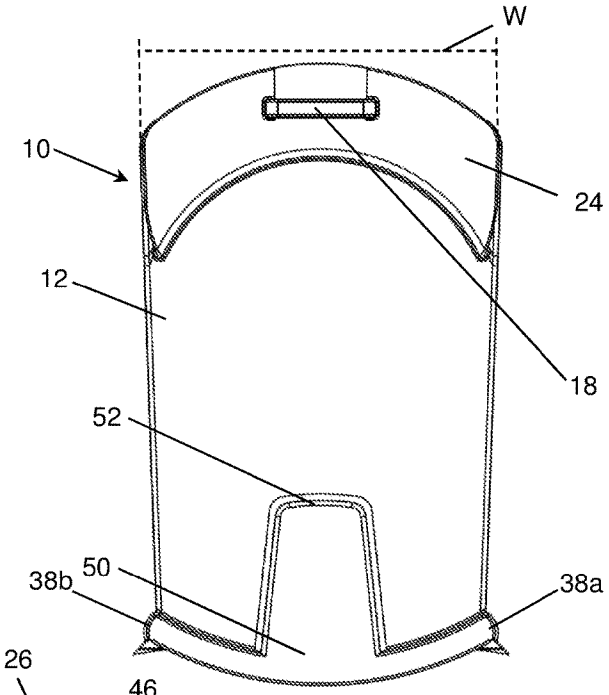
FIG. 3 is a front view of the tape roll dispenser shown in FIG. 1.
Figure 2:
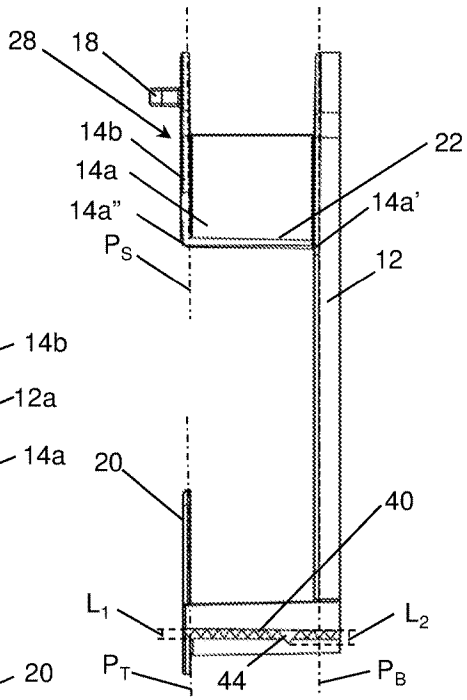
FIG. 2 is a side view of the tape roll dispenser shown in FIG. 1.
Figure 4:
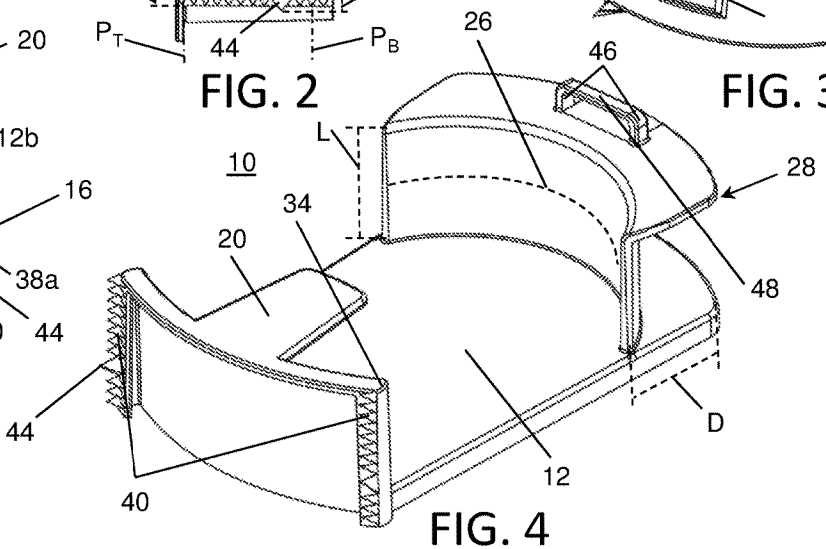
FIG. 4 is a bottom perspective view of the tape roll dispenser shown in FIG. 1.
Figure 1:
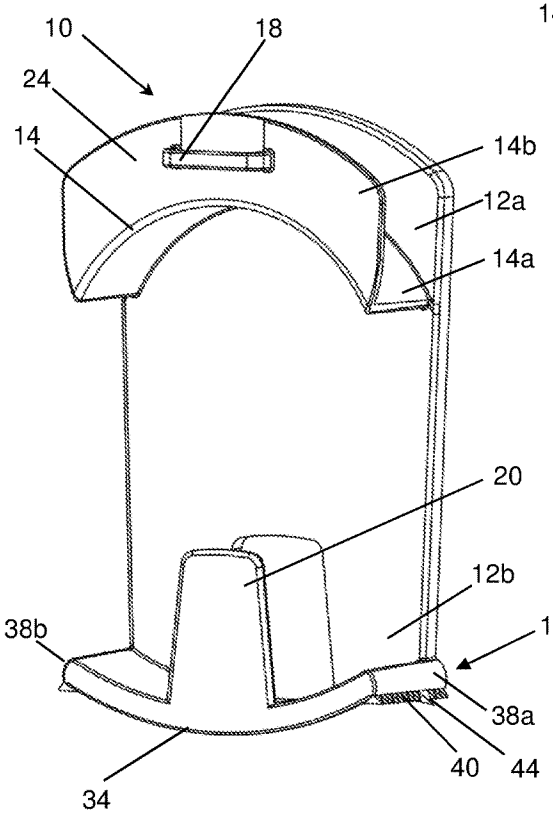
FIG. 1 is a front perspective view of a tape roll dispenser according to the present invention.

The following description of the preferred embodiment(s) is merely exemplary in nature and is in no way intended to limit the invention, its application, or uses.

The tape roll holder of the present invention serves as a tape roll dispenser 10 for segments of tape from a roll of adhesive tape 100 and also provides a place to hold a pen 110 that can be used to mark tape segments. Generally, as shown in FIGS. 1-7, the tape roll dispenser has a backplate 12, a spindle 22, a cutting surface 16, a tab 20, and a writing device holder 18. It will be appreciated that the tab and marking pen holder are optional features of the tape roll dispenser. As explained in more detail below, the tab extends upwardly from a location proximate to the lower section of the backplate 12*b* and is preferable for the embodiment shown in the drawings in which the spindle serves as a hook 28 formed by an arcuate channel 14 with a bottom trough 14*a* and an integral sidewall 14*b* proximate to the upper section of the backplate 12*a*, and the roll of tape hangs from the hook by gravity. In operation, a person pulls on the end of the tape and the roll of tape rotates on the spindle relative to the backplate around an axis of rotation 36, and the tab helps prevent the roll of tape's lower side from swinging away from the backplate while the tape is rotating and also while the segment of tape is being cut from the roll on the serrated edge 40 as described below.

The tape roll dispenser 10 can be attached to a vertical surface, such as a wall or door, using any type of fastener. Without limitation, examples of fasteners that can be used to mount the tape roll dispenser to a vertical surface include double sided tape, magnets, screws, epoxy or glue, and hook and loop fasteners.

The upper section and the lower section of the backplate are preferably arranged within a single plane ($P_B$) which so that the backplate's entire backside surface can be mounted flush to a vertical surface. The bottom trough of the arcuate channel is attached to the upper section of the backplate at its proximal end 14*a*' and extends substantially perpendicular to the backplate by a length (L) that is preferably shorter than the side-to-side width (W) of the bottom trough. The sidewall is located at the distal end of the bottom trough 14*a*" and is arranged in a plane ($P_S$) that is substantially parallel to the plane of the backplate (i.e., $P_S \parallel P_B$). Accordingly, in functioning like a hook, the spindle has a width that is greater than the length. In particular, the arcuate channel has an arc length 26 that is less than a semicircle, preferably greater than 60° and less than 120°. Preferably, the top of the sidewall is approximately aligned with the top of the backplate, and the depth (D) of the bottom trough between the sidewall and the backplate is less than the length of the bottom trough.

The cutting surface extends substantially perpendicular to the lower section of the backplate to a distal edge of the cutting surface 34. The length of the cutting surface from the backplate is approximately equal to the length of the bottom trough. Preferably, the cutting surface extends from the bottom edge of the backplate and has a pair of sides 38*a*, 38*b* that are beneath the opposite sides of the arcuate channel so that its width is similar in size to the width of the bottom trough. At least one of the cutting surface's sides has a serrated edge 40 and preferably both sides have a serrated edge which are substantially parallel to the axis of rotation. The serrated edge further has two sets of teeth with a first length ($L_1$) and a tooth 44 positioned between the sets of teeth 42*a*, 42*b* which has a second length ($L_2$) that is greater than the first length ($L_2 > L_1$). The longer tooth 44 helps to initiate the cut in the tape and is preferably offset to be closer towards the backplate so that when a person pulls a segment of tape to be torn from the roll, the shorter width of the tape that tears is closer to the backplate and wall on which the dispenser is mounted while the longer width of the tape that tears is closer to the person who is pulling the tape. The sides of the cutting surface also preferably include a landing space above the serrated edge which allows a portion of the adhesive tape to stick while the segment of tape is being separated from the roll.

The tab has a base 50 that is preferably attached to the distal edge of the cutting surface and extends upwardly to a tip 52. The tab is arranged in a plane ($P_T$) that is substantially parallel to the backplate's plane (i.e., $P_T \parallel P_B$) and positioned at a center section of the cutting surface between the sides with the serrated edges. The tab's plane ($P_T$) is preferably aligned in the same plane as the sidewall's plane ($P_S$). Since there is no sidewall in the lower section of the backplate, the tab prevents the roll of tape from swinging outwards while it is rotating on the spindle. Although not shown in the drawings, it will be appreciated that the base of the tab could be connected directly to the backplate with a bend between the base and the tip.

Figure 7:
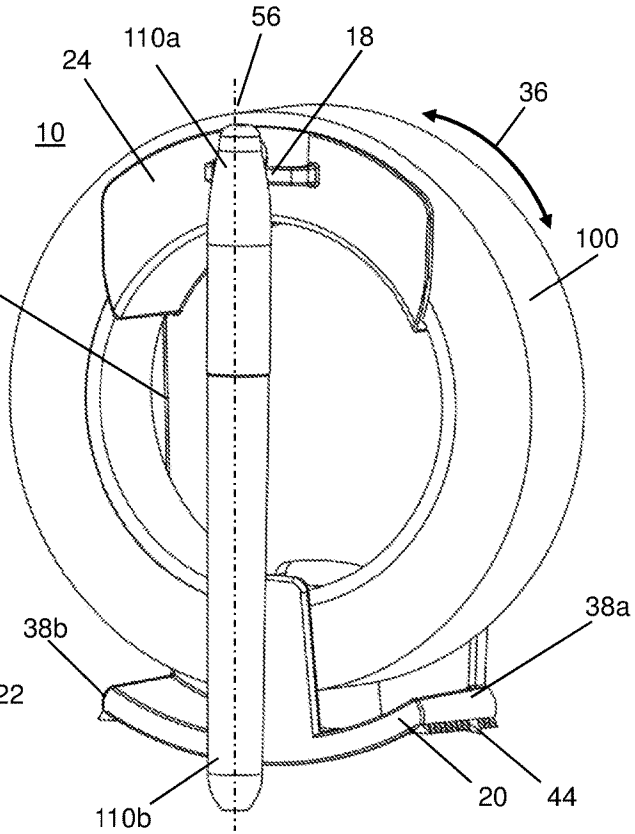
FIG. 7 is a front perspective view of the tape roll dispenser shown in FIG. 1 with a roll of tape and a marking pen held thereon.
Figure 6:
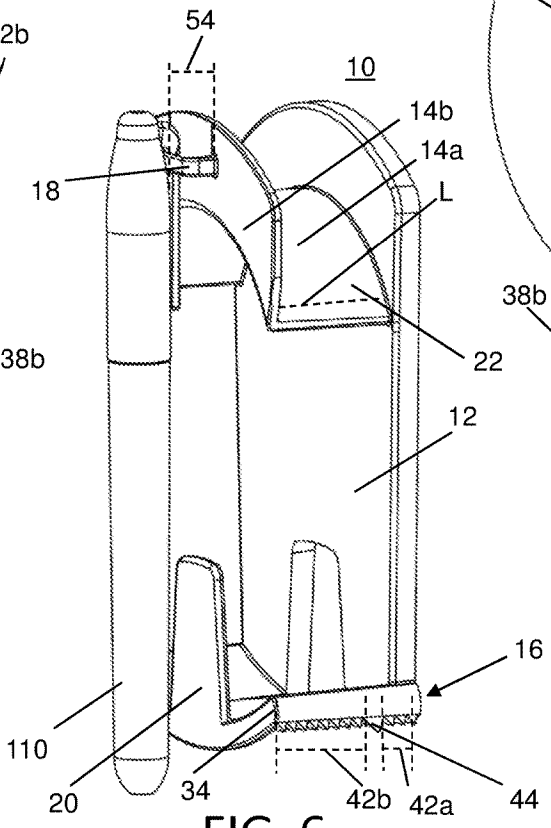
FIG. 6 is a side perspective view of the tape roll dispenser shown in FIG. 1 with a marking pen held thereon.
Figure 5:
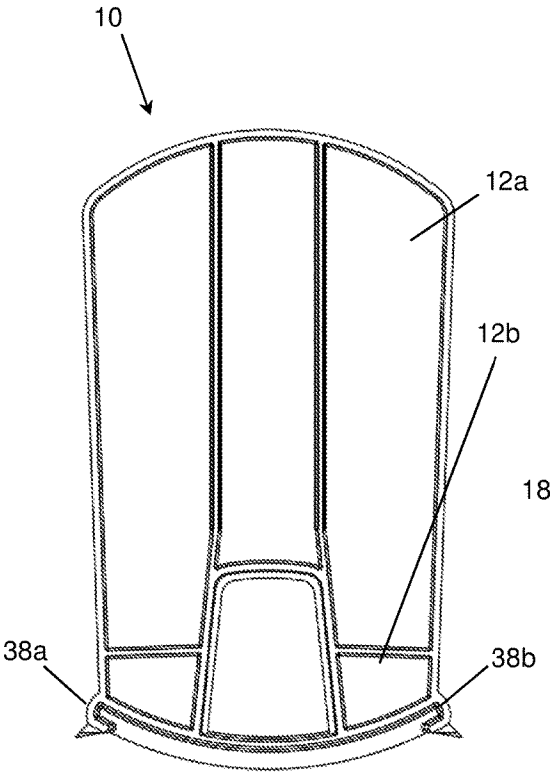
FIG. 5 is a back view of the tape roll dispenser shown in FIG. 1.

The writing device holder is preferably attached to an external face of the sidewall 24 of the arcuate channel with a longitudinal axis 56 that is parallel to the backplate's plane. In the embodiment shown in the drawings, the writing device holder has a pair of posts 46 extending substantially perpendicular to the external face and a bar 48 connected between the posts. As shown in FIGS. 6 and 7, the sidewall separates the roll of tape from a proximal end 110*a* of the writing device 110 that is engaged with the bar, and a distal end of the writing device 110*b* extends to a location proximate to the distal edge of the cutting surface approximately equidistant between the pair of sides of the cutting surface. It will be appreciated that the writing device holder can be attached to the tape roll dispenser 10 anywhere that is spaced a sufficient distance 54 away from the roll of tape to avoid an interference between the roll and the pen. For example the writing device holder can be connected to the side of the backplate in a manner similar to the design shown in the '002 Design Patent. It will also be appreciated that the writing device holder could be attached to the top or bottom of the backplate or to the spindle or the cutting surface. For example, the writing device holder may be a friction fit aperture which is attached to the top of the tab or below the cutting surface or below the arcuate channel similar to the pen holder in the '276 Patent. Other writing device holders might be other type of friction fit connections or clips or may even use hook and loop fasteners.

The roll of tape's hanging position depicted in FIG. 7 is achieved by positioning the open core of the roll around the arcuate channel while the bottom portion of the tape roll is positioned above the tab. The core is then lowered into the arcuate channel while the bottom portion of the tape roll is situated between the tab and the lower section of the backplate, allowing the roll to hang from the arcuate channel while the tab prevents the roll of tape from swinging outwardly from the backplate. Accordingly, a user can replace rolls of tape on the tape dispenser of the present invention without any disassembly or opening actions so that the user can remove and place rolls of tape on the dispenser with a single hand and without having to separately manipulate parts on the spindle. After the roll is placed in the channel, the writing device can then be hung from the writing device holder by placing the writing device's clip structure over the bar which is preferably an integral structure of the dispenser. It will be appreciated that the length that the arcuate channel extends from the upper section of the backplate and the corresponding distance of the tab from the lower section of the backplate can be optimized to fit particular sizes of tape. For example, some painting tape is only around one inch (1") in width which is approximately half the standard width of masking tape, duct tape, and packing tape. The illustrations show a channel that would fit the thinner width painting tape, and it will be appreciated that a longer extension of the bottom trough from the backplate would accommodate the wider type of tape.

The advantages of the present invention include, without limitation, the maximum space savings and minimum visual distraction it provides over current adhesive tape storage and dispensing devices made possible by its ability to store a roll of tape up and out of the way parallel to a vertical surface such as a wall, cabinet, or refrigerator door as opposed to on a table, countertop, or in a drawer. In addition, as the device is designed to function as a fixture to remain stationed in a single location on a semi-permanent to permanent basis, the present invention provides a constant and reliable location users can always expect to find and access a roll of tape unlike current adhesive tape storage and dispensing devices which are often moved and misplaced during use. Additionally, the open design of the present invention's arcing channel on which rolls of tape are meant to simply hang upon as a hook rather than be secured by more complicated apparatus allows for rolls to be quickly and easily removed and replaced and makes the process of removing and replacing rolls much faster and more simple than current tape holders and dispensers that require opening or partial disassembly of the device to access and place rolls of tape within. Also, by integrating a means to hang a marking pen along with a roll of tape, the preferred embodiment of the present invention provides a functionality not found on any previous adhesive tape roll storage and dispensing devices making it easy to use tape in conjunction with a marking pen as a convenient labeling solution. It will also be recognized that the tape roll dispenser 10 of the present invention can be produced as an integral, molded device with no moving parts so it may be produced more affordably than other, more complicated tape storage and dispensing devices and may present a lower-cost option for consumers.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiment shows a spindle with an integral sidewall, it will be appreciated that the aspects of the present invention, such as the writing device holder, could be incorporated into previously known tape dispensers that are vertically mounted, such as the '229 Patent and the '734 Patent. As another example, although not preferred, the present invention could have spindles as disclosed in these previously known tape dispensers which require a separate structure, such as a cap or head structure or a sleeve, that connects to the spindle; according to the preferred embodiment of the present invention, the spindle is formed by the bottom trough with the integral sidewall and acts like a hook so there is no need for a separate structure. Thus, the breadth and scope of the present invention should not be limited by any of the above-described exemplary embodiments, but should be defined only in accordance with the following claims appended hereto and their equivalents.

What is claimed is:

1. A dispenser for a roll of adhesive tape, comprising:

a backplate extending from an upper section to a lower section;

an arcuate channel comprising a bottom trough and a sidewall, wherein the bottom trough is attached to the upper section of the backplate and extends substantially perpendicular to the backplate by a first distance to a distal end, wherein the sidewall is located at the distal end of the bottom trough, and wherein the arcuate channel has an arc length less than a semicircle;

a cutting surface extending substantially perpendicular to the lower section of the backplate by a second distance to a distal edge of the cutting surface, wherein the cutting surface comprises a pair of sides, and wherein at least one of the sides comprises a serrated edge; and a tab comprising a base and a tip, wherein the base is connected to the lower section of the backplate, wherein the tab extends upwardly towards the bottom trough from the base to the tip, and wherein the tab is spaced from the backplate by a distance approximately equal to the first distance and blocks the roll of adhesive tape from swinging outwards from the backplate when hanging from the arcuate channel.

2. The dispenser of claim 1, further comprising a writing device holder attached to an external face of the sidewall of the arcuate channel.

3. The dispenser of claim 2, wherein the writing device holder is comprised of a pair of posts extending substantially perpendicular to the external face and a bar connected between the posts.

4. The dispenser of claim 3, wherein the pair of posts and the bar space a writing device engaged with the bar from the roll of tape by a third distance with the sidewall separating the roll of tape from the writing device, wherein both of the pair of sides of the cutting surface comprise the serrated edge, and wherein the tab is positioned at a center section of the cutting surface between the sides with the serrated edges.

5. The dispenser of claim 1, wherein the upper section and the lower section of the backplate are in a first plane, wherein the bottom trough and the sidewall of the arcuate channel form a hook with a width greater than a length, wherein the sidewall is in a second plane substantially parallel to the first plane, wherein the second distance is substantially equal to the first distance, wherein the roll of adhesive tape engages the arcuate channel and rotates in the arcuate channel relative to the backplate around an axis of rotation perpendicular to the first plane, wherein the pair of sides of the cutting surface are spaced from each other by a distance approximately equal to the width of the bottom trough, and wherein the serrated edge is substantially parallel to the axis of rotation.

6. The dispenser of claim 5, wherein the base of the tab is attached to the distal edge of the cutting surface, wherein the tab is positioned in the second plane and wherein the cutting surface is arcuate between the pair of sides.

7. The dispenser of claim 1, wherein the serrated edge further comprises a plurality of teeth with a first length and at least one tooth having a second length with a second length greater than the first length.

8. The dispenser of claim 7, wherein the plurality of teeth with the first length are comprised of a first set of teeth and a second set of teeth, wherein the tooth with the second length is positioned between the first set of teeth and the second set of teeth, and wherein both of the pair of sides of the cutting surface comprise the serrated edge.

9. A dispenser for a roll of adhesive tape, comprising:

a backplate extending from a first section to a second section in a first plane;

a spindle attached to the first section of the backplate and extending substantially perpendicular to the first plane by a first distance to a distal end, wherein the roll of adhesive tape engages the spindle and rotates on the spindle relative to the backplate around an axis of rotation perpendicular to the first plane;

a cutting surface extending substantially perpendicular to the second section of the backplate by a second distance to a distal edge, wherein the cutting surface comprises a pair of sides, wherein at least one of the sides comprises a serrated edge, and wherein the serrated edge is substantially parallel to the axis of rotation; and a writing device holder attached to at least one of the backplate, the spindle, and the cutting surface, wherein the writing device holder is comprised of a pair of posts extending substantially perpendicular to the external face and a bar connected between the posts, wherein the writing device holder is spaced a distance from the roll of adhesive tape engaged with the spindle.

10. The dispenser of claim 9, wherein the spindle is comprised of an arcuate channel comprising a bottom trough and a sidewall.

11. The dispenser of claim 10, further compromising a tab, wherein the tab comprises a base and a tip, wherein the base is connected to the second section of the backplate, wherein the tab extends towards the bottom trough from the base to the tip, and wherein the tab is spaced from the backplate by a distance approximately equal to the first distance and blocks the roll of adhesive tape from swinging outwards from the backplate when hanging from the arcuate channel.

12. The dispenser of claim 9, further comprising a tab, wherein the tab extends from a base to a tip, wherein the base is connected to the second section of the backplate, wherein the tip extends toward the spindle from the base, and wherein the tab is spaced from the backplate by a distance approximately equal to the first distance and blocks the roll of adhesive tape from swinging outwards from the backplate when hanging from the spindle.

13. The dispenser of claim 9, wherein the serrated edge further comprises a plurality of teeth with a first length and at least one tooth having a second length with a second length greater than the first length.

14. The dispenser of claim 9, further comprising a tab extending from a base to a tip, wherein the spindle is comprised of an arcuate channel compromising a bottom trough and a sidewall, wherein the base of the tab is connected to the second section of the backplate, and wherein the tab is arranged in a second plane substantially parallel to the first plane of the backplate and blocks the roll of adhesive tape from swinging outwards from the backplate when hanging from the arcuate channel.

15. A dispenser for a roll of adhesive tape, comprising:

a backplate extending from a first section to a second section in a first plane;

a spindle attached to the first section of the backplate, wherein the spindle comprises a bottom trough and a sidewall, wherein a proximal end of the bottom trough is attached to the first section of the backplate, wherein the bottom trough extends substantially perpendicular to the first plane by a first distance to a distal end, wherein the sidewall is located at the distal end of the bottom trough and is arranged substantially parallel to the backplate, wherein the roll of adhesive tape engages the spindle and rotates on the spindle relative to the backplate around an axis of rotation perpendicular to the first plane, and wherein the sidewall is located only adjacent to the upper section of the backplate and there is no sidewall in the lower section;

a cutting surface extending substantially perpendicular to the second section of the backplate by a second distance to a distal edge, wherein the cutting surface comprises a pair of sides, and wherein each of the sides comprise a serrated edge; and a tab comprising a base attached to the lower section of the backplate and a tip extending upward from the base towards the bottom trough, and wherein the tip is separated from the backplate by a space approximately equal to the first distance.

16. The dispenser of claim 15, wherein the bottom trough and the sidewall form a hook with a width greater than a length.

17. The dispenser of claim 16, wherein the hook is an arcuate channel with an arc length less than a semicircle.

18. The dispenser of claim 15, further comprising a writing device holder attached to at least one of the backplate, the spindle, the cutting surface and the tab, wherein the writing device holder is spaced a distance from the roll of adhesive tape engaged with the spindle, and wherein the writing device holder is comprised of a pair of posts extending substantially perpendicular to the external face and a bar connected between the posts.

19. The dispenser of claim 15, wherein each of the serrated edges further comprise a plurality of teeth with a first length and at least one tooth having a second length with a second length greater than the first length, and wherein the serrated edge is substantially parallel to the axis of rotation.

20. The dispenser of claim 15, wherein the tab is arranged in a second plane substantially parallel to the first plane.

21. A dispenser for a roll of adhesive tape, comprising:

a backplate extending from a first section to a second section in a first plane;

a spindle attached to the first section of the backplate and extending substantially perpendicular to the first plane by a first distance to a distal end, wherein the roll of adhesive tape engages the spindle and rotates on the spindle relative to the backplate around an axis of rotation perpendicular to the first plane; and a cutting surface extending substantially perpendicular to the second section of the backplate by a second distance to a distal edge, wherein the cutting surface comprises a pair of sides, wherein at least one of the sides comprises a serrated edge, and wherein the serrated edge further comprises a plurality of teeth with a first length and at least one tooth having a second length with a second length greater than the first length.

22. The dispenser of claim 21, further comprising a writing device holder attached to at least one of the backplate, the spindle, and the cutting surface.

23. The dispenser of claim 22, wherein the writing device holder is comprised of a pair of posts extending substantially perpendicular to the external face and a bar connected between the posts, and wherein the spindle is comprised of an arcuate channel comprising a bottom trough and a sidewall.

24. The dispenser of claim 21, further comprising a tab, wherein the tab extends from a base to a tip, wherein the base is connected to the second section of the backplate, wherein the tip extends toward the spindle from the base, and wherein the tab is spaced from the backplate by a distance approximately equal to the first distance and blocks the roll of adhesive tape from swinging outwards from the backplate when hanging from the spindle.

25. The dispenser of claim 21, further comprising a writing device holder and a tab, wherein the spindle is comprised of an arcuate channel comprising a bottom trough and a sidewall, wherein the writing device holder is attached to at least one of the backplate, the spindle, the cutting surface, and the tab, wherein the tab extends from a base to a tip, wherein the base is connected to the second section of the backplate, wherein the tip extends toward the bottom trough from the base, and wherein the tab is spaced from the backplate by a distance approximately equal to the first distance and blocks the roll of adhesive tape from swinging outwards from the backplate when hanging from the spindle.

* * * * *